US006392154B1

(12) United States Patent
Lee et al.

(10) Patent No.: US 6,392,154 B1
(45) Date of Patent: May 21, 2002

(54) FAST CURING POLYMER COMPOSITION

(75) Inventors: Lester Y. Lee, Hamilton; Steven W. Horwatt, West Chester, both of OH (US)

(73) Assignee: Equistar Chemicals, LP, Houston, TX (US)

( * ) Notice: Subject to any disclaimer, the term of this patent is extended or adjusted under 35 U.S.C. 154(b) by 0 days.

(21) Appl. No.: 09/826,056

(22) Filed: Apr. 4, 2001

(51) Int. Cl.[7] ..... H01B 7/00
(52) U.S. Cl. ..... 174/110 R; 524/94; 428/389
(58) Field of Search ..... 174/110 R, 110 PM, 174/110 SR; 428/389, 461; 524/94, 410, 411, 412

(56) References Cited

U.S. PATENT DOCUMENTS

| | | | | | |
|---|---|---|---|---|---|
| 3,819,410 | A | | 6/1974 | Kuckro et al. | 117/232 |
| 4,260,661 | A | | 4/1981 | Walters et al. | 428/389 |
| 4,857,673 | A | | 8/1989 | Wilkus et al. | 174/110 |
| 5,955,525 | A | * | 9/1999 | Sanchez et al. | 524/264 |
| 6,133,367 | A | * | 10/2000 | Arhart | 524/515 |

* cited by examiner

*Primary Examiner*—Chau N. Nguyen
(74) *Attorney, Agent, or Firm*—Kevin M. Carroll

(57) ABSTRACT

An insulating composition for electrical conductors that is composed essentially of an ethylene-vinyl acetate copolymer, a zinc salt, aluminum trihydrate, and a peroxide curing agent is surprisingly found to have excellent long-term thermal stability with fast cure.

13 Claims, No Drawings

FAST CURING POLYMER COMPOSITION

FIELD OF THE INVENTION

This invention relates to a composition useful as insulating conductors. The composition consists essentially of an ethylene-vinyl acetate copolymer, a zinc salt, aluminum trihydrate, and a peroxide curing agent. This insulating composition surprisingly provides excellent long-term thermal stability with fast cure.

BACKGROUND OF THE INVENTION

Many different compositions are used as polymeric insulators for electrical conductors. These compositions typically contain a polymer or copolymer, such as polyethylene or ethylene-vinyl acetate copolymer. However, these polymers alone are ineffective insulators due to oxidative degradation of the polymeric material at the higher temperatures usually found in electrical devices.

Because of the instability of the polymers as insulators, various additives are typically mixed with the polymeric materials to impart stabilization. Standard additives useful for coating materials for electrical conductors include hindered phenol antioxidants such as Irganox 1010 or Irganox 1035. Other additives that are added to the insulating materials include zinc salts, peroxide curing agents, antimony oxide, lead compounds, and others. Usually, the insulators contain a large number of these additives in their formulation. See for example, U.S. Pat. Nos. 4,857,673, 4,260,661, and 3,819,410. However these additives, in particular the phenol antioxidants, are expensive and add additional cost to the insulation.

Another typical problem encountered in developing suitable insulating compositions is that the cure rates for these compositions are often too slow for certain applications. For instance, fast cure rates are desirable in applications where high processing line speed is necessary, particularly in the automotive wire application area. It would thus be useful to find a composition that would allow for fast cure rates.

In sum, new insulating compositions for electrical conductors are needed. Particularly valuable insulating compositions would have improved heat aging properties and fast cure for higher processing line speeds. Ideally, the new compositions would also have a minimal amount of additives in order to lower formulation cost.

SUMMARY OF THE INVENTION

The invention is an insulating composition consisting essentially of a copolymer of ethylene and vinyl acetate, a zinc salt of a mercaptobenzimidazole, aluminum trihydrate, and a peroxide curing agent consisting of para and meta isomers of α,α'-bis(t-butylperoxy) diisopropyl benzene. It is surprisingly found that the insulating composition has improved thermal stability and fast cure.

DETAILED DESCRIPTION OF THE INVENTION

The insulating composition of the invention consists essentially of a copolymer of ethylene and vinyl acetate and a number of additives. The additives are a zinc salt of a mercaptobenzimidazole, aluminum trihydrate, and a peroxide curing agent consisting of para and meta isomers of α,α'-bis(t-butylperoxy) diisopropyl benzene. The composition has improved heat-aging and fast cure properties.

Copolymers of ethylene and vinyl acetate are well known in the art. Ethylene-vinyl acetate copolymers preferably contain between about 5 and 35 weight percent vinyl acetate, most preferably between about 15 and 25 weight percent vinyl acetate.

Ethylene-vinyl acetate is mixed with various additives to form the insulating composition of the invention. The amount of ethylene-vinyl acetate copolymer useful in the composition ranges from about 30 to about 65 weight percent of the entire weight of the composition mixture, and preferably from about 40 to about 50.

The inventive composition also contains a zinc salt of a mercaptobenzimidazole. Zinc salts of a mercaptobenzimidazole are well known in the art. Preferably, the zinc salt of a mercaptobenzimidazole has the formula

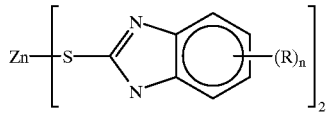

where R is a $C_{1-4}$ alkyl group and n is 0 to 4. Most preferably, the zinc salt of a mercaptobenzimidazole is zinc mercaptotolyl imidazole. The amount of zinc salt useful in the composition ranges from about 0.5 to about 6.0 weight percent of the entire composition mixture, and preferably from about 1.5 to about 3.0 weight percent.

Aluminum trihydrate-is also contained in the insulating composition. The aluminum trihydrate is useful as a flame-retardant filler for the composition. The aluminum trihydrate accounts for approximately 30 to about 70 weight percent of the composition mixture, and preferably from about 45 to about 55 weight percent.

The insulating composition of the invention also contains a peroxide curing agent consisting of para and meta isomers of α,α'-bis(t-butylperoxy) diisopropyl benzene. The peroxide curing agent is useful for cross-linking the polymer. The peroxide curing agent component can vary in amount from about 0.2 to about 2.0 weight percent of the composition mixture, and preferably from about 0.4 to about 1.0 weight percent.

The composition of the invention may also contain pigments, lubricants, and processing aids provided that they do not interfere with cross-linking or detract from the physical properties of the composition. A processing aid can also be added to the mixture to facilitate extrusion. Preferred processing aids include alkoxysilane additives. Any conventional alkoxysilane known in the art can be used as long as it does not combust or degrade during polymer processing or interfere with crosslinking. Alkoxysilanes having 2 or 3 $C_{1-3}$ alkoxy substituents, e.g., methoxy, ethoxy, propoxy, or combinations thereof, are particularly advantageous. Illustrative silanes include methyltriethoxysilane, methyltris(2-methoxyethoxy)silane, dimethyldiethoxylsilane, ethyltrimethoxysilane, vinyltris(2-methoxyethoxy)silane, phenyltris(2-methoxyethoxy)silane, vinyltrimethoxysilane, vinyltriethoxysilane, and gamma-methacryloxypropyl trimethoxysilane. The alkoxysilane component, if present, can vary in amount from about 0.2 to about 3.0 weight percent of the composition mixture, and preferably from about 0.5 to about 2.0 weight percent.

The copolymer and additives are mixed using any conventional procedure. Mixing technology is well known in the prior art. For instance, an internal mixer such as a Banbury mixer can be used. Other high shear internal mixers, including Farrel continuous mixer, Boiling Mixtrumat™, or Werner & Pfleiderer mixers, can also be used in the mixing procedure.

Typically, the copolymer, zinc salt, and aluminum trihydrate are first mixed together before the peroxide curing agent is added. The peroxide is then added to the first mixture under controlled temperature conditions. The temperature of peroxide mixing should be controlled in order to prevent premature cross-linking. Preferred peroxide mixing temperatures range from about 80 to about 120° C., with 90 to 110° C. being most preferred.

The resulting pellets are then applied to electrical conductors to form an insulating layer surrounding the conductor. The layer provides insulation and physical protection for the conductor and flame retardancy for the jacketed conductor. The composition mixture is applied using any conventional coating techniques. Coating methods are well known in the art. A typical procedure is to apply the composition by extruding a substantially uniform 2 to 100 mil thick layer onto a metal conductor. More typically, insulation thicknesses will range from 10 to 60 mils. The extrusion is carried out using a single screw extruder at the desired line speeds. Curing is typically accomplished by passing the insulated wire through a steam tube maintained at 260 psi immediately following extrusion.

The following examples merely illustrate the invention. Those skilled in the art will recognize many variations that are within the spirit of the invention and scope of the claims.

EXAMPLE 1

Preparation of Insulating Materials

The formulations are prepared by combining all of the ingredients and blending in a Banbury mixer at 110° C.

EXAMPLE 1A

An example of the composition of the invention is prepared by adding 1572 grams of ethylene-vinyl acetate (EVA, 82% ethylene, 18% vinyl acetate, product of Equistar Chemicals), 1887 grams of aluminum trihyd rate (ATH, product of Alcoa), 79 grams of zinc mercaptotolyl imidazole (ZMTI, product of R. T. Vanderbilt), 22 grams of para and meta isomers of α,α'-bis(t-butylperoxy) diisopropyl benzene (Vulcup, product of Hercules), and 35 grams of vinyltrimethoxysilane, as a coupling agent for the ATH (product of Huls). The final composition contains 43.74% EVA, 52.49% ATH, 2.20% ZMTI, 0.61% Vulcup, and 0.96% vinyltrimethoxysilane.

COMPARATIVE EXAMPLE 1B

A comparative example is prepared according to the procedure of Example 1A, except that 1593 grams of EVA, 1912 grams of ATH, 20 grams of Vulcup, and 35 grams of vinyltrimethoxysilane is used. Also, 23 grams of Irganox 1010 (product of Ciba Specialty Chemicals), and 12 grams of Seenox 412S (product of Witco) is used in place of ZMTI. The final composition of Comparative Example 1B contains 44.30% EVA, 53.19% ATH, 0.65% Irganox 1010, 0.33% Seenox 412S, 0.56% Vulcup, and 0.97% processing aid.

COMPARATIVE EXAMPLE 1C

A second comparative example is prepared according to the procedure of Example 1A, except that 1600 grams of EVA, 1926 grams of ATH, 27 grams of Vulcup, and 19 grams of vinyltrimethoxysilane is used. Also, 28 grams of Irganox 1010, 19 grams of Irganox 1035 (product of Ciba), and 3 grams of Seenox 412S is used in place of ZMTI. The final composition of Comparative Example 1C contains 44.17% EVA, 53.17% ATH, 0.77% Irganox 1010, 0.53% Irganox 1035, 0.09% Seenox 412S, 0.74% Vulcup, and 0.53% processing aid.

Table 1 contains a comparison of the amounts of additives found in the insulating compositions.

EXAMPLE 2

Heat Aging Test

The heat aging test is conducted according to procedures described in the SAE J1128 (Society of Automotive Engineering) standard. Wire samples at 22 AWG and 10 mil wall are aged in an oven at 125° C. for a maximum of 3000 hours.

The formulations from Example 1 are extruded onto 22 AWG copper wire at a wall thickness of 10 mil. The extrusion is carried out using a single screw extruder (L/D 20 to 1; 14 rpm; heating zones set at 225–235° F.; heat temperature 240° F.) at a line speed of 2000 ft/min. Eight-inch wire samples with one-inch of insulation removed from both ends are then hung in a convection oven maintained at 125° C.

The samples are removed from the oven and subjected to a winding test at time intervals of 30, 60, 75, 90, 100, 110, 120, 125, and 145 days. After cooling the samples to room temperature, they are coiled around a mandrel three times. After winding, the samples are visually inspected for the formation of cracks.

The formulation of the invention (Example 1A) withstood 145 days heat aging before failure. By comparison, the formulation of Comparative Example 1C failed after just 30 days heat aging. The improvement in stability using the formulation of the invention is over 4 times greater than the comparative example.

EXAMPLE 3

Fast Curing Wire Line Test

Cure rates are determined by two independent methods.

Method 1 uses the Monsanto oscillating disc rheometer (ODR) to determine the time to reach 50% ($t_{1/2}$) of the maximum torque achievable by the material under curing condition. ODR samples are prepared by hot-melting the pellets in a mixer to form a small pancake, and 8–10 grams is used for testing.

Method 2 analyzes the gel content of the wire insulation processed in a production line at various line speeds according to ASTM D 2765-84. The wire line is a typical commercial line that consists of a single extruder (L/D 20 to 1; 14 rpm; heating zones set at 225–235° F.; heat temperature 240° F.), and a vulcanization tube maintained at 240 psi. Wires are coated at different line speeds with all other process parameters unchanged.

The results are summarized in Table 2. The formulation of Example 1A gives an equivalent or greater amount of crosslinking compared to Comparative Examples 1B and 1C, as measured by $ODR_{max}$. However, the formulation of Example 1A cures at a significantly faster rate than either Comparative Examples 1B and 1C, as measured by the time to reach 50% of the maximum torque achievable ($t_{1/2}$). The faster cure rate for the formulation of Example 1A is confirmed in the line speed test. The line speed test shows a faster gel rate for the formulation of Example 1A compared to Comparative Example 1B.

The overall results show that the composition of the invention has improved heat-aging properties and faster cure rates at high line speed than the comparative examples using typical phenolic antioxidants.

TABLE 1

Compositions of Examples.

| Ex. # | Vulcup (wt. %) | Irgano × 1010 (wt. %) | Irgano × 1035 (wt. %) | Seenox 412s (wt. %) | ZMTI (wt. %) |
|---|---|---|---|---|---|
| 1A | 0.61 | — | — | — | 2.2 |
| * 1B | 0.56 | 0.65 | — | 0.33 | — |
| * 1C | 0.74 | 0.77 | 0.53 | 0.09 | — |

* Comparative Examples.

TABLE 2

Cure Rate and Line Speed Results.

| Ex. # | $ODR_{max}$ | $t_{½}$ (min) | Line Speed (fpm) | Gel |
|---|---|---|---|---|
| 1A | 84 | 1.85 | 2000 | 82.0 |
| | | | 2400 | 80.0 |
| | | | 2800 | 79.5 |
| *1B | 76 | 2.2 | 2000 | 80.0 |
| | | | 2400 | 80.0 |
| | | | 2800 | 71.5 |
| *1C | 85 | 2.45 | — | — |

*Comparative Examples.

We claim:

1. An insulating composition consisting essentially of:

(a) a copolymer of ethylene and vinyl acetate, wherein the copolymer is present in an amount of from about 30 to about 65 weight percent, based on the total weight of the insulating composition;

(b) a zinc salt of a mercaptobenzimidazole, wherein the zinc salt is present in an amount of from about 0.5 to about 6.0 weight percent, based on the total weight of the insulating composition;

(c) aluminum trihydrate, wherein the aluminum trihydrate is present in an amount of from about 30 to about 70 weight percent, based on the total weight of the insulating composition; and (d) a peroxide curing agent consisting of para and meta isomers of α,α'-bis(t-butylperoxy) diisopropyl benzene, wherein the peroxide curing agent is present in an amount of from about 0.2 to about 2.0 weight percent, based on the total weight of the insulating composition.

2. The composition of claim 1 wherein the copolymer of ethylene and vinyl acetate is present in an amount of from about 40 to about 50 weight percent, based on the total weight of the insulating composition.

3. The composition of claim 1 wherein the zinc salt of a mercaptobenzimidazole is present in an amount of from about 1.5 to about 3.0 weight percent, based on the total weight of the insulating composition.

4. The composition of claim 1 wherein the aluminum trihydrate is present in an amount of from about 45 to about 55 weight percent, based on the total weight of the insulating composition.

5. The composition of claim 1 wherein the peroxide curing agent is present in an amount of from about 0.4 to about 1.0 weight percent, based on the total weight of the insulating composition.

6. An electrical conductor bearing a layer of insulating composition of claim 1.

7. An insulating composition consisting essentially of:

(a) a copolymer of ethylene and vinyl acetate, wherein the copolymer is present in an amount of from about 30 to about 65 weight percent, based on the total weight of the insulating composition;

(b) a zinc salt of a mercaptobenzimidazole, wherein the zinc salt is present in an amount of from about 0.5 to about 6.0 weight percent, based on the total weight of the insulating composition;

(c) aluminum trihydrate, wherein the aluminum trihydrate is present in an amount of from about 30 to about 70 weight percent, based on the total weight of the insulating composition;

(d) an alkoxysilane, wherein the alkoxysilane is present in an amount of from about 0.2 to about 3.0 weight percent, based on the total weight of the insulating composition; and (e) a peroxide curing agent consisting of para and meta isomers of α,α'-bis(t-butylperoxy) diisopropyl benzene, wherein the peroxide curing agent is present in an amount of from about 0.2 to about 2.0 weight percent, based on the total weight of the insulating composition.

8. The composition of claim 7 wherein the copolymer of ethylene and vinyl acetate is present in an amount of from about 40 to about 50 weight percent, based on the total weight of the insulating composition.

9. The composition of claim 7 wherein the zinc salt of a mercaptobenzimidazole is present in an amount of from about 1.5 to about 3.0 weight percent, based on the total weight of the insulating composition.

10. The composition of claim 7 wherein the aluminum trihydrate is present in an amount of from about 45 to about 55 weight percent, based on the total weight of the insulating composition.

11. The composition of claim 7 wherein the alkoxysilane is present in an amount of from about 0.5 to about 2.0 weight percent, based on the total weight of the insulating composition.

12. The composition of claim 7 wherein the peroxide curing agent is present in an amount of from about 0.4 to about 1.0 weight percent, based on the total weight of the insulating composition.

13. An electrical conductor bearing a layer of insulating composition of claim 7.

* * * * *